United States Patent [19]

Sherman

[11] 4,342,646

[45] Aug. 3, 1982

[54] TRACE SOLVENT RECOVERY IN SELECTIVE SOLVENT EXTRACTION

[75] Inventor: Philip B. Sherman, Orange, Tex.

[73] Assignee: Texaco Inc., White Plains, N.Y.

[21] Appl. No.: 190,421

[22] Filed: Sep. 24, 1980

[51] Int. Cl.[3] ..... C10G 21/20

[52] U.S. Cl. ..... 208/326

[58] Field of Search ..... 208/321, 326

[56] References Cited

U.S. PATENT DOCUMENTS

| | | | |
|---|---|---|---|
| 3,291,728 | 12/1966 | Boyum et al. | 208/321 |
| 3,338,823 | 8/1967 | Voetter | 208/313 |
| 3,451,925 | 6/1969 | Morris et al. | 208/324 |
| 3,461,066 | 3/1969 | Morris et al. | 208/321 |
| 3,619,419 | 11/1971 | Thompson | 208/321 |
| 3,714,033 | 1/1973 | Somekh et al. | 208/321 |
| 4,214,975 | 7/1980 | Davis et al. | 208/33 |

*Primary Examiner*—Delbert E. Gantz
*Assistant Examiner*—William T. Leader
*Attorney, Agent, or Firm*—Carl G. Ries; Robert A. Kulason; George J. Darsa

[57] ABSTRACT

A process for the substantially complete recovery of N-methyl-2-pyrrolidone solvent from the raffinate and extract products of solvent refining of a petroleum base lubricating oil stock by vaporization of the major portion of the solvent from the product followed by extraction of a minor portion of the solvent with water. The process results in substantially complete removal of solvent from the refined oil and extract products and results in energy savings as compared with conventional processes.

2 Claims, 1 Drawing Figure

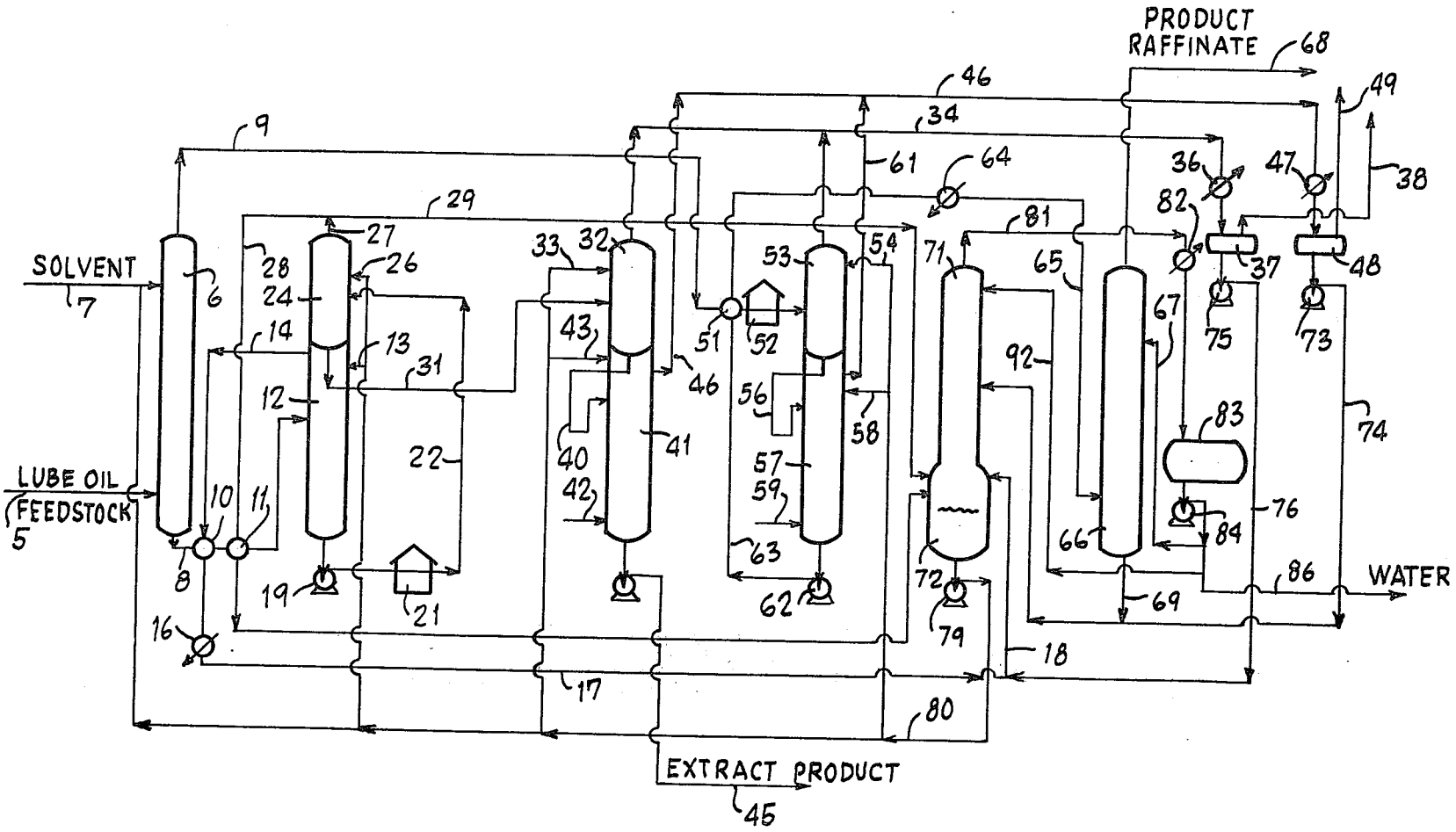
PRODUCT RAFFINATE
WATER
EXTRACT PRODUCT
SOLVENT
LUBE OIL FEEDSTOCK

TRACE SOLVENT RECOVERY IN SELECTIVE SOLVENT EXTRACTION

This invention relates to an improved process for the solvent extraction of a petroleum oil fraction containing aromatic and non-aromatic components. In one of its more specific aspects, the process involves an improved method of recovering solvent from refined oil in a solvent extraction system for removal of aromatic and unsaturated components from hydrocarbon feedstocks. The process of the invention effects the recovery of solvent from the raffinate phase in a plurality of separation steps comprising both solvent distillation and water extraction. Savings in the energy requirements of a solvent extraction process, as compared with processes employing conventional solvent recovery operations, are realized by my process.

It is well known that aromatic and unsaturated components of a lubricating oil base stock, such as those derived from crude petroleum by fractional distillation, may be separated from the more saturated hydrocarbon components by various processes involving solvent extraction of the aromatic and unsaturated hydrocarbons. Foremost among the processes which have received widespread commercial acceptance are those in which the selective solvent is furfural, N-methyl-2-pyrrolidone, phenol, or a combination of these solvents. Removal of aromatics and other undesirable constituents from lubricating oil base stocks improves the viscosity index, color, oxidative stability, thermal stability, and inhibition response of the base oils and the ultimate lubricating oil products formulated from the base oils. N-methyl-2-pyrrolidone is a preferred solvent for extracting aromatic hydrocarbons from mixtures of aromatic and non-aromatic hydrocarbons. The advantages of N-methyl-2-pyrrolidone as a lubricating oil extraction solvent for the removal of undesirable aromatic and polar constituents from lubricating oil base stocks is now well recognized. The process of this invention is particularly useful for the recovery of trace amounts of N-methyl-2-pyrrolidone from refined oils.

Water has been used heretofore for the recovery of N-methyl-2-pyrollidone from solvent refined oils. Prior art patents illustrating conventional solvent recovery operations include U.S. Pat. Nos. 3,451,925 and 3,461,066.

The process of this invention is particularly adaptable to existing refinery installations employing N-methyl-2-pyrrolidone solvent extraction systems.

In conventional lubricating oil refining, the solvent extraction step is carried out under conditions effective to recover about 30 to 90 volume percent of the lubricating oil charge as raffinate or refined oil and to extract about 10 to 70 volume percent of the charge as an aromatic extract. The lubricating oil stock is contacted with a solvent, such as N-methyl-2-pyrrolidone, at a temperature at least 10° C., preferably at least 50° C., below the temperature of complete miscibility with the lubricating oil stock undergoing treatment.

A number of solvents are known which have an affinity for at least one component of a mixed base lubricating oil charge stock and which are partially immiscible with the lubricating oil charge stock under conditions in the oil-solvent contacting zone. The two liquid phases in the contacting zone generally consist essentially of an extract phase containing the major amount of the solvent together with dissolved aromatic components of the charge stock and a raffinate phase containing non-aromatic components of the charge stock together with minor amounts of solvent.

A particularly preferred solvent is N-methyl-2-pyrrolidone, which is effective for solvent extraction of aromatic components from lubricating oil charge stocks at relatively lower temperatures and lower solvent-to-oil dosages than most other known solvents. N-methyl-2-pyrrolidone is generally the most preferred solvent because of its chemical stability, low toxicity, and its ability to produce refined oils of improved quality.

In the extraction step, operating conditions are selected to produce a primary raffinate having a dewaxed viscosity index (VI) of about 75 to 100, and preferably about 85 to 96. Optimum operatng conditions are dependent on the nature of the charge stock and the desired VI of the refined oil product. When N-methyl-2-pyrrolidone is employed as solvent, solvent extraction temperatures within the range of 43° to 100° C. (110° to 212° F.), and preferably within the range of 54° to 95° C. (130° to 205° F.), with solvent dosages within the range of 50 to 500 percent, and preferably within the range of 100 to 300 percent, are employed to produce refined oil of desired VI.

To produce a finished lubricating oil base stock, the primary raffinate is dewaxed to the desired pour point. If desired, the refined or dewaxed oil may be subjected to a finishing treatment for color and stability improvement, for example, mild hydrogenation.

In one embodiment of the process of the present invention, N-methyl-2-pyrrolidone is recovered from a raffinate phase by a combination of steps in which the major portion of said solvent is separated from said raffinate by vaporization, preferably in successive distillation zones at different pressures, stripped with steam or inert gas, and water washed to produce solvent-free refined oil. A preferred separation system, hereinafter described, effects savings in the amount of energy required for the recovery of the solvent from the raffinate and ensures complete removal of solvent from product oils.

Details of the invention will be evident from the accompanying drawing and the following detailed description of the process of this invention as applied to an illustrative N-methyl-2-pyrrolidone solvent refining operation.

The FIGURE is a schematic flow diagram illustrating a solvent refining process employing an improved solvent recovery operation in accordance with the process of this invention.

With reference to the drawing, lubricating oil feedstock is introduced through line 5 to an extraction tower 6 where it is intimately countercurrently contacted with N-methyl-2-pyrrolidone solvent entering the upper portion of extraction tower 6 through line 7. In the extraction tower 6, the lubricating oil feedstock is intimately contacted with N-methyl-2-pyrrolidone as selective solvent. An extract mixture comprising about 85 percent solvent is withdrawn from the bottom of extraction tower 6 through line 8.

The raffinate mixture, comprising typically 85 percent hydrocarbon oil admixed with solvent, is discharged from the extraction tower 6 through line 9 and processed for the recovery of raffinate from the solvent as described hereinafter. The raffinate, after the separation of solvent, is the solvent refined lubricating oil base stock, i.e., the desired product of the process.

Various methods may be employed for the separation and recovery of solvent from the extract and raffinate mixtures. The exact nature of the recovery system depends to some extent upon the history of a particular solvent refining installation, for example, whether the plant was originally designed for furfural, N-methyl-2-pyrrolidone, or phenol, and whether the solvent also contains water as a moderator. In a typical process, the raffinate is recovered by vaporizing solvent from the raffinate in a vacuum flash separation unit followed by stripping the raffinate with steam or an inert gas. Usually water must be removed from the solvent prior to reuse of the solvent in the process. Water may enter the system with the hydrocarbon feed, or as a result of steam stripping, leaks in heat exchangers, upsets in operations, and the like.

The major portion of the solvent appears in the extract mixture withdrawn from the bottom of extraction tower 6 through line 8. The extract mixture is processed first for the recovery of solvent from the extract and then for recovery of the extract as a marketable product of the process. The extract mixture, typically containing about 85 percent of the solvent, is passed through line 8 and heat exchangers 10 and 11 which serve to preheat the extract mixture, and introduced into the upper part of a low pressure flash tower 12. Tower 12 typically operates at a pressure 17 to 85 kPa (1 to 5 psig). Solvent is introduced into the upper part of tower 12 as reflux through line 13. Solvent separated from the extract in tower 12 is discharged through line 14 to heat exchanger 10 wherein it is cooled by indirect heat exchange with the extract mixture from extraction tower 6 thereby preheating the extract mixture prior to introduction to flash tower 12 and condensing solvent vapors. The solvent is further cooled and condensed in a cooler 16 and passed through lines 17 and 18 to a distillation tower 71, described in more detail hereinafter.

The unvaporized portion of the extract mixture is withdrawn from the bottom of flash tower 12 by pump 19 and passed through a heater 21, wherein it is heated to an elevated temperature, and introduced through line 22 to a high pressure flash tower 24. The high pressure flash tower 24 suitably is maintained at a pressure within the range of 375 to 415 kPa (40 to 45 psig) and is provided with a reflux of solvent which enters the upper part of tower 24 through line 26.

A further amount of solvent is separated from the extract in tower 24, the solvent rich vapors leaving the top of the tower through line 27. Part of the vapors from line 27 are passed through line 28 to heat exchanger 11 for indirect heat exchange with extract mixture from the lower part of extraction tower 6, serving to condense the solvent vapors and preheat the extract mixture prior to its introduction to column 12. Following the heat exchange, the condensed solvent is passed through line 28 to solvent purification and storage as described hereinafter. The remainder of the solvent vapors passing overhead from high pressure separator 24 pass through line 29 to the solvent purification and storage system.

The hydrocarbon oil extract, still containing some solvent, for example, a mixture of 85 volume percent hydrocarbon oil and 15 volume percent solvent, is withdrawn from the lower portion of high pressure flash tower 24 through line 31 to vacuum flash tower 32. Dry solvent is introduced near the top of the tower 32 through line 33 as reflux. In the vacuum flash tower 32, additional separation of extract from solvent takes place. Solvent vapors are withdrawn from the upper portion of flash tower 32 through line 34 to a condenser 36 and solvent accumulator 37. Uncondensed gases are withdrawn from accumulator 37 through line 38.

An extract rich fraction is withdrawn from the lower part of vacuum flash tower 32 through line 40 and introduced into the upper portion of stripper 41. Stripper 41 is typically a countercurrent vapor-liquid contact column provided with bubble trays in which the liquid extract flowing downwardly through the tower is contacted with inert stripping gas or steam introduced into the lower portion of the stripper 41 through line 42. Solvent is introduced near the top of stripping column 41 through line 43 as reflux. Extract oil containing trace amounts of solvent and typically comprising 80 percent unsaturated hydrocarbons and about 20 percent saturated hydrocarbons is withdrawn from the lower part of stripper 41 by pump 44 and may be water washed for solvent recovery or discharged through line 45 as a product of the process.

Solvent vapors mixed with stripping medium, i.e., inert gas or steam, and usually containing also some light oil carried over from the flash tower and stripper, are discharged from the upper part of the stripper 41 through line 46 to condenser 47 and solvent accumulator 48. Condensate is separated from uncondensible gases in solvent accumulator 48, and the gases are withdrawn from accumulator 48 through line 49 to a vacuum system, not illustrated in the drawing.

The raffinate mixture leaving the top of the extraction column 6 through line 9 is passed through a heat exchanger 51 and heater 52 wherein the raffinate mixture is heated, and then introduced into a vacuum flash tower 53, similar to vacuum flash tower 32, previously described. Vacuum flash tower 53 is provided with a means for the introduction of solvent through line 54 to the upper portion of the tower as reflux. Solvent vapors are taken overhead from flash tower 53 to line 34 for recovery together with solvent from flash tower 32.

The unvaporized portion of the raffinate mixture is withdrawn from the bottom of vacuum flash tower 54 through line 56 and introduced into the upper portion of a stripping column 57 similar to stripping column 41, previously described. Solvent is introduced into stripper 57 as a reflux through line 58 and a stripping medium, e.g., inert gas or steam, is introduced near the bottom of the stripper through line 59. Stripping medium and solvent vapors are discharged from stripper 57 through lines 61 and 46 to condenser 47 for recovery together with the stripping medium and solvent from stripper 41.

The bottoms product from stripper 57, containing 0.1 to 1.0 weight percent solvent, is passed by a pump 62 through line 63 to heat exchanger 51 where it is cooled by indirect heat exchange with the incoming feed to the vacuum flash tower 53 and through cooler 64 where it is cooled to about 65° C. (150° F.) and passed through line 65 to wash tower 66.

Wash tower 66 is a liquid-liquid extraction column providing about 1 to 10 theoretical stages. Water at about 65° C. is introduced through line 67 at a rate within the range of 4 to 10 parts by weight water per part solvent contained in said raffinate. Washed solvent-refined product freed from N-methyl-2-pyrrolidone is discharged through line 68 as refined lubricating oil base stock, the principal product of the process.

Wash water, containing dissolved N-methyl-2-pyrrolidone, is withdrawn from wash tower 66 through line 69 to a fractional distillation tower 71 for separation of water from the solvent. Distillation tower 71 is operated as a solvent dryer in which water is removed overhead as distillate and dry solvent is recovered as a bottoms product. Distillation tower 71 is provided with a reboiler section 72 which serves also as a dry solvent accumulator. Solvent recovered from high pressure separator 24 is passed through line 28 to the solvent accumulator 72. Solvent recovered in condensate accumulator 48 is returned to distillation tower 71 by pump 73 via line 74 while that accumulated in accumulator 37 is passed by pump 75 to distillation tower 71 through lines 76 and 18. Distillation tower 71 typically is provided with a series of bubble-tray contacters for efficient countercurrent vapor-liquid contact. Dry N-methyl-2-pyrrolidone is accumulated in the solvent accumulator 72 and recirculated by pump 79 through line 80 to lines 7, 13, 26, 33, 43, 54, and 58. Steam passing overhead from fractionation tower 71 through line 81 is cooled and condensed by condenser 82 and the condensate water collected in accumulator drum 83. Water from accumulator drum 83 is passed by pump 84 to wash tower 66 via line 67 and to the top of distillation tower 71 through line 85 as reflux. Excess water is removed from the system through line 86.

The process of this invention contemplates recovery of residual amounts of solvent from the extract product as well as from the raffinate product. In this embodiment of the invention, not illustrated in the drawing, stripper 41 is normally operated such that the extract product withdrawn from the stripper contains from about 0.1 to about 1.0 weight percent solvent. The extract product is then washed with water as described hereinabove in connection with water washing of the raffinate, employing from 4 to 10 parts water by weight per part of solvent remaining in the extract product withdrawn from the stripper.

Washing of the product fractions with water not only removes trace amounts of N-methyl-2-pyrrolidone from the product refined lubricating oil base stock, and optionally also from the product extract, but also ensures removal of solvent from the product fractions so treated during periods of upsets in operations. The combination of solvent vaporization and recovery by water washing for complete solvent recovery in accordance with the process of this invention has some advantages over recovery of solvent by water washing alone or by distillation alone. Distillation of water from solvent requires, on an equal weight basis, considerably more heat than that required for distillation of solvent from oil. Therefore it is desirable to accomplish most of the solvent recovery by distillation of solvent from oil rather than by water washing. At the same time, an excessive amount of stripping medium is required for complete removal of solvent from product. Distillation of water from solvent is necessary in any N-methyl-2-pyrrolidone solvent system, regardless of whether or not water or wet solvent is employed as a solvent moderator in the process, in order to remove water entering the system from an extraneous source. Water may enter the system extraneously with the hydrocarbon feed, through leakage in heat exchangers, or as a result of steam stripping operations. The process of this invention provides complete removal of solvent with less steam or inert gas stripping than conventional process operations effecting a saving in energy required for the process.

I claim:

1. In a process for solvent refining a petroleum based lubricating oil stock containing aromatic and non-aromatic components wherein said lubricating oil stock is contacted with substantially water-free N-methyl-2-pyrrolidone as solvent effecting separation of said lubricating oil stock into an aromatics-rich extract fraction comprising a major portion of said solvent and an aromatics-poor raffinate fraction comprising a minor portion of said solvent, and solvent is recovered from each of said fractions by distillation and steam stripping, the improvement which comprises steam stripping said raffinate to a residual solvent content in the range of 0.1 to 1.0 weight percent, and contacting the resulting stripped raffinate fraction with water in a water extraction step in an amount equivalent to 4 to 10 parts water by weight per part solvent contained in said stripped raffinate thereby extracting substantially all remaining solvent from said raffinate and producing a solvent-free raffinate product and wash water comprising solvent recovered from said product, separating water from said wash water by distillation and thereby recovering water-free solvent from said wash water, and returning said water-free solvent to said lubricating oil stock contacting step as a portion of the solvent therefor.

2. The process of claim 1 wherein said extract after said distillation and steam stripping contains 0.1 to 1.0 weight percent solvent, said stripped extract is contacted with water in an amount within the range of 4 to 10 parts water by weight per part solvent contained in said extract producing an extract product and wash water comprising solvent, and said wash water is subjected to distillation for the recovery of water-free solvent therefrom, and said water-free solvent returned to said lubricating oil stock contacting step.

* * * * *